US007611088B1

(12) United States Patent
Yu Chen

(10) Patent No.: US 7,611,088 B1
(45) Date of Patent: Nov. 3, 2009

(54) DOUBLE-SIDED ADHESIVE TAPE DISPENSER

(76) Inventor: Hsiu-Man Yu Chen, No. 40, Sec. 1, Ta Fu Rd., Tan Tzu Township, Taichung County (TW)

( * ) Notice: Subject to any disclaimer, the term of this patent is extended or adjusted under 35 U.S.C. 154(b) by 0 days.

(21) Appl. No.: 12/190,686

(22) Filed: Aug. 13, 2008

(51) Int. Cl.
*B65D 85/02* (2006.01)

(52) U.S. Cl. ..... 242/588.2; 242/588.6; 156/579

(58) Field of Classification Search ..... 242/588, 242/588.2, 588.6, 538.1–538.3; 156/344, 156/584, 579
See application file for complete search history.

(56) References Cited

U.S. PATENT DOCUMENTS 3,969,181 A * 7/1976 Seabold ..... 156/577
6,550,518 B1 * 4/2003 Lee ..... 156/577
6,705,373 B1 * 3/2004 Yu Chen ..... 156/523
7,121,499 B2 * 10/2006 Lammers et al. ..... 242/588.6
7,334,753 B2 * 2/2008 Yu Chen ..... 242/538.1
7,350,553 B2 * 4/2008 Yu Chen ..... 156/526

FOREIGN PATENT DOCUMENTS

WO WO 2006/032175 A1 * 3/2006

* cited by examiner

*Primary Examiner*—Sang Kim
(74) *Attorney, Agent, or Firm*—Ming Chow Sinorica, LLC

(57) ABSTRACT

A double-sided adhesive tape dispenser includes a main housing composed of a fitting casing and a fitting cover, which have the upper corresponding sides mutually assembled with a pivotal member. The fitting casing has its inside disposed with an insert recess, two engage pins and a tape-winding mechanism. The fitting cover has its inside fixed with an engage member, plural projecting rings and an engage projection. The tape-winding mechanism consists of a pair of winding wheels and a guide-press member, and one winding wheel has its outer end installed with a tape reel. The guide-press member is pivotally provided with a press roller and an actuating wheel having its surface annularly disposed with several flanges. By so designing, the fitting cover can easily be opened for replacing the tape reel, and the double-sided adhesive tape dispenser can be easily and smoothly dragged for use.

7 Claims, 6 Drawing Sheets

DOUBLE-SIDED ADHESIVE TAPE DISPENSER

BACKGROUND OF THE INVENTION

1. Field of the Invention

This invention relates to a newly designed double-sided adhesive tape dispenser, particular to one easy to replace a tape reel and convenient in use.

2. Description of the Prior Art

In an assembly line process, double-sided adhesive tape is always used for fixing articles and a double-sided adhesive tape dispenser is usually employed for elevating working velocity.

A conventional double-sided adhesive tape dispenser, as shown in FIG. 1, includes a fitting casing 1 and a fitting cover 2 respectively provided with plural insert recesses 1*a* and engage members 2*b* to be respectively engaged with each other. The fitting casing 1 has its inner wall axially fixed thereon with two fixing shafts 1*b* extending outward vertically and arranged side by side. The fitting casing 1 and the fitting cover 2 have their front side mutually bored with a tape outlet 3, and the fitting casing 1 has a lower side secured with a handle unit 4 pivotally disposed with a control member 5 having its topside fixed with an engage tooth 5*a* extending upward. A tape-winding mechanism 6 is assembled inside the fitting casing 1 and composed of a pair of winding wheels 6*a* respectively having one end set with a gear secured with the winding wheel. The two winding wheels 6*a* are a first winding wheel 6*a*1 and a second winding wheel 6*a*2 respectively and pivotally fitted on the two fixing shafts 1*b*, and the engage tooth 5*a* is engaged with the gear of the first winding wheel 6*a*1. Further, the first winding wheel 6*a*1 has its outer end of its center shaft, opposite to the fitting casing 1, installed with a tape reel 6*b* wound thereon with separable paper 6*c*, which has its outer surface stuck with a double-sided adhesive tape. Further, a guide-press member 7 is provided at a location facing the outer side of the tape outlet 3, pivotally disposed thereon with a drive wheel 8 and a press roller 9. The separable paper 6*c* has its outer surface passing along the drive wheel 8 and then has its inner surface passing along the press roller 9 and finally has its end secured on the second winding wheel 6*a*2.

However, since the contact area between the drive wheel 8 and the adhesive is too large, the conventional double-sided adhesive tape dispenser cannot smoothly be dragged for use. In addition, when the tape reel 6*b* needs to be replaced with a new one, it is necessary to disengage the engage members 2*a* of the fitting cover 2 one by one from the insert recesses 1*a* of the fitting casing 1 for opening the fitting cover 2 and then have the fitting cover 2 placed at somewhere or held by hand, complicated in replacing of the tape reel 6*b* and inconvenient in use.

SUMMARY OF THE INVENTION

The objective of this invention is to offer a double-sided adhesive tape dispenser including a main housing composed of a fitting casing and a fitting cover, which have their corresponding sides mutually assembled with a pivotal member. The fitting casing is provided with a handle unit at a lower side opposite to the pivotal member, and the fitting casing and the fitting cover have their front sides mutually bored with a tape outlet. Further, the fitting casing and the fitting cover are respectively disposed with an insert recess and an engage member at a side near the tape outlet to be engaged with each other. The fitting cover has its inside fixed with an engage projection extending out axially, and the handle unit has its upper side bored with an insert hole at a location corresponding with the engage projection. The engage projection and the insert hole will be mutually engaged when the fitting cover is covered on the fitting casing. Furthermore, the fitting casing and the fitting cover have their inner sides respectively secured thereon with two engage pins and plural projecting rings to be respectively engaged with each other.

A tape-winding mechanism assembled in the fitting casing is provided with a guide-press member pivotally disposed thereon with a press roller and a drive wheel having its wheel surface annularly formed with several flanges arranged side by side. Two winding wheels are respectively fitted on the two engage pins, respectively having one end set with a gear secured thereon. The two winding wheels consist of a first winding wheel and a second winding wheel, and the first winding wheel has its outer end, opposite to the fitting casing, installed with a tape reel wound thereon with a roll of separable paper, which has its outer surface stuck with a double-sided adhesive tape. The separable paper has its outer surface passing along the drive wheel and then its inner surface passing along the press roller and finally has its end fixed on the second winding wheel.

By so designing, simply disengage only the engage member of the fitting cover from the insert recess of the fitting casing and thus the fitting cover can be opened. In addition, the fitting cover and the fitting casing are connected together by the pivotal member; therefore, after opened, the fitting cover is needless to be taken off and placed at somewhere or held by hand, facilitating to replace the tape reel. Moreover, the plural flanges formed on the surface of the actuating wheel diminish the contact area between the adhesive and the drive wheel to enable the double-sided adhesive tape dispenser to be dragged for use easily and smoothly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
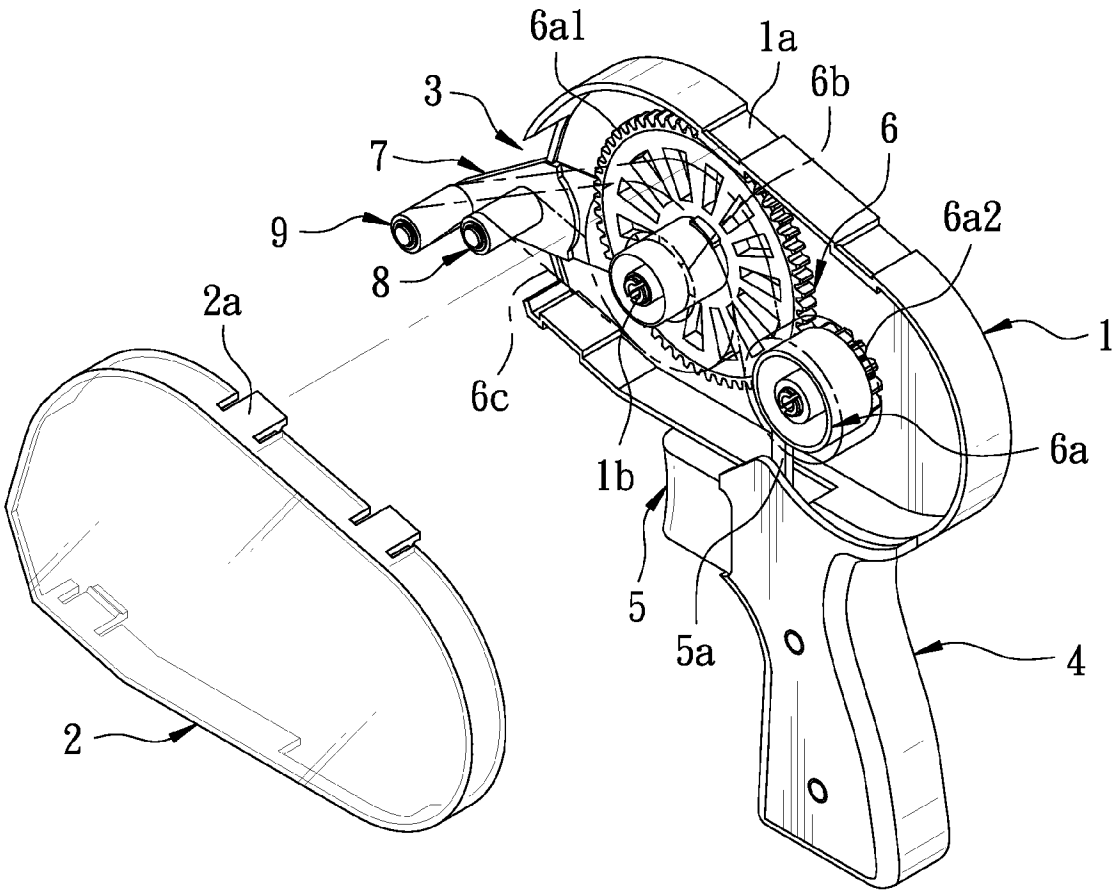
FIG. 1 PRIOR ART
FIG. 1 is an exploded perspective view of a conventional double-sided adhesive tape dispenser.
Figure 2:
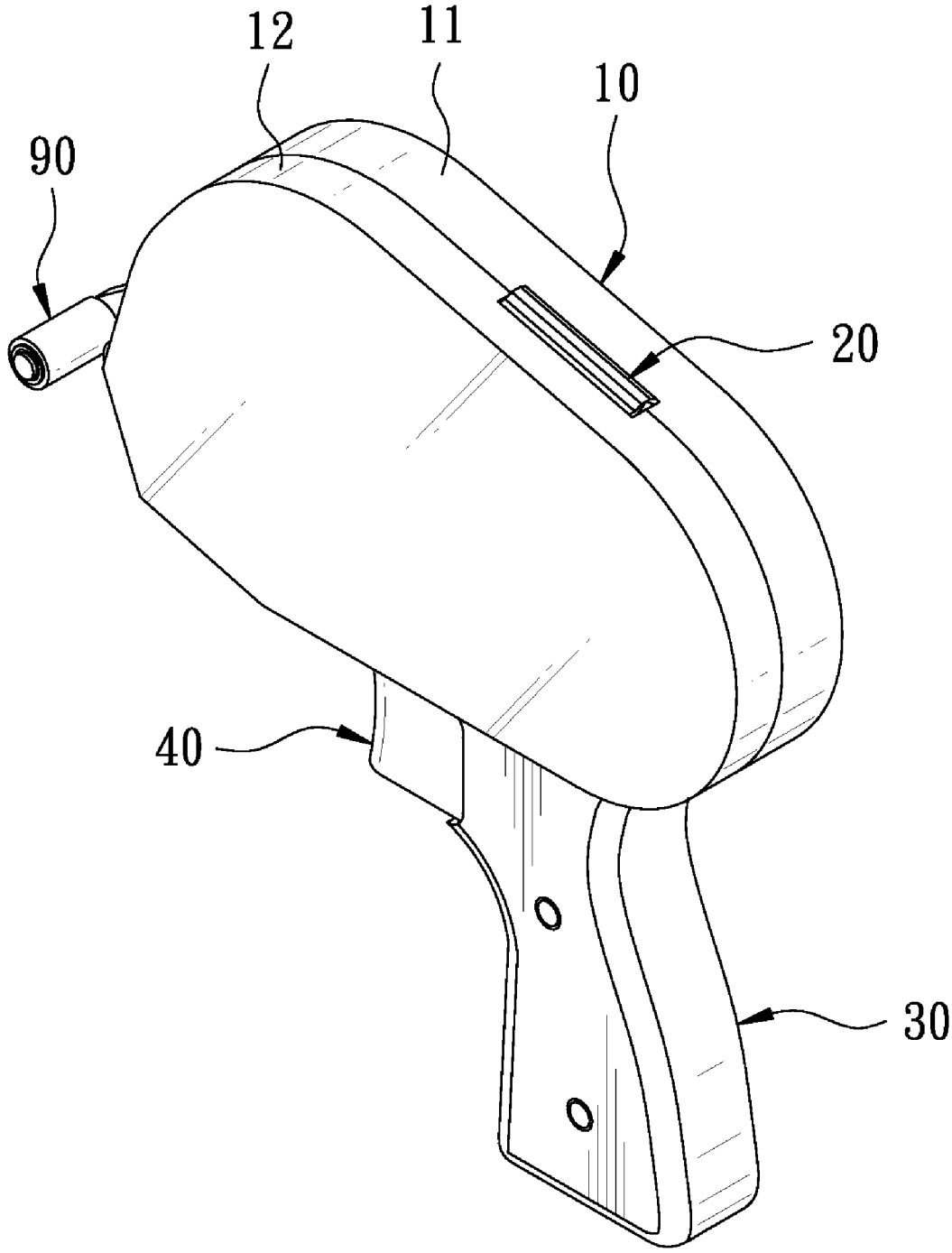
FIG. 2 is a perspective view of a double-sided adhesive tape dispenser in the present invention.
Figure 3:
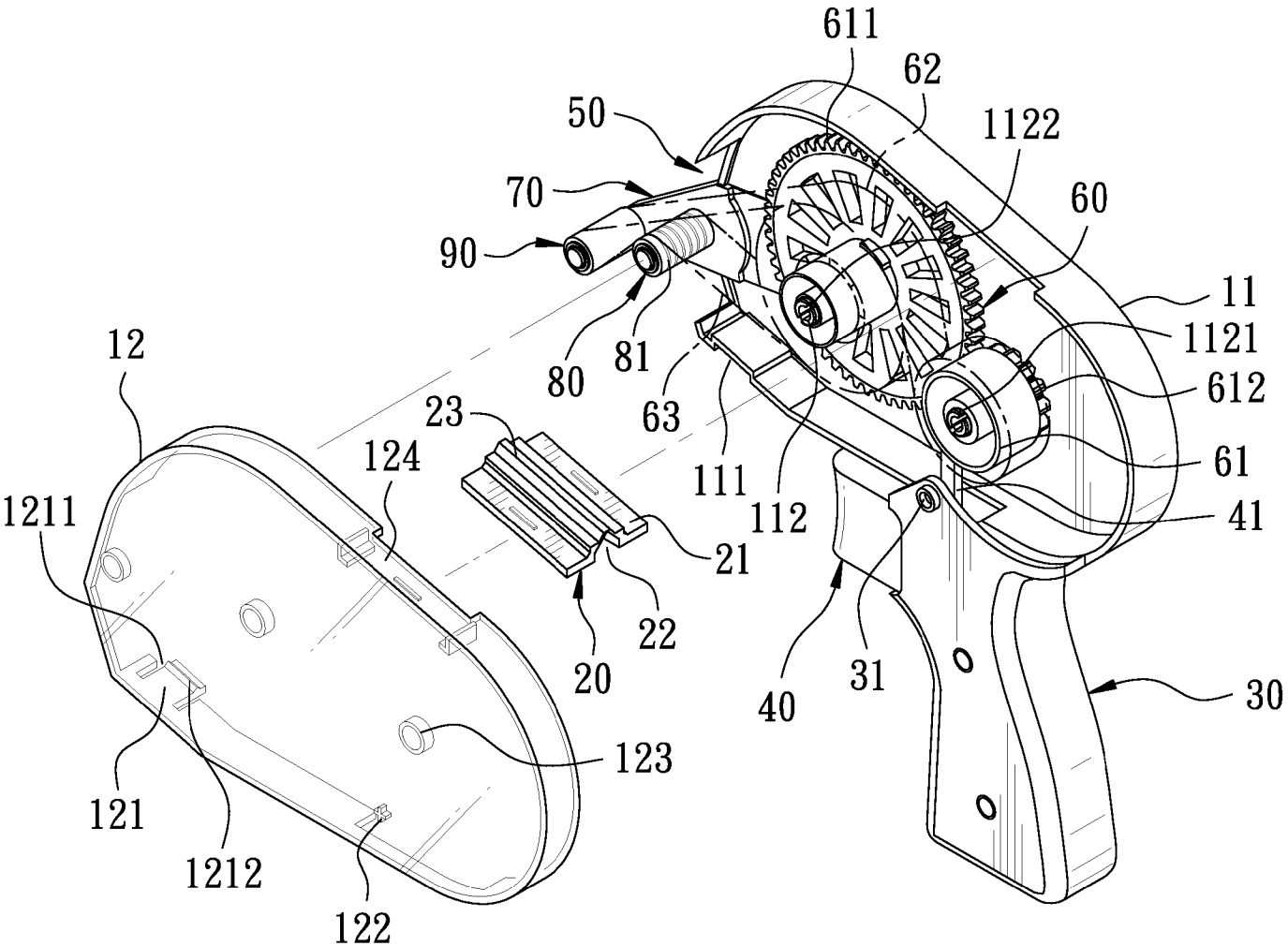
FIG. 3 is an exploded perspective view of the double-sided adhesive tape dispenser in the present invention.
Figure 4:
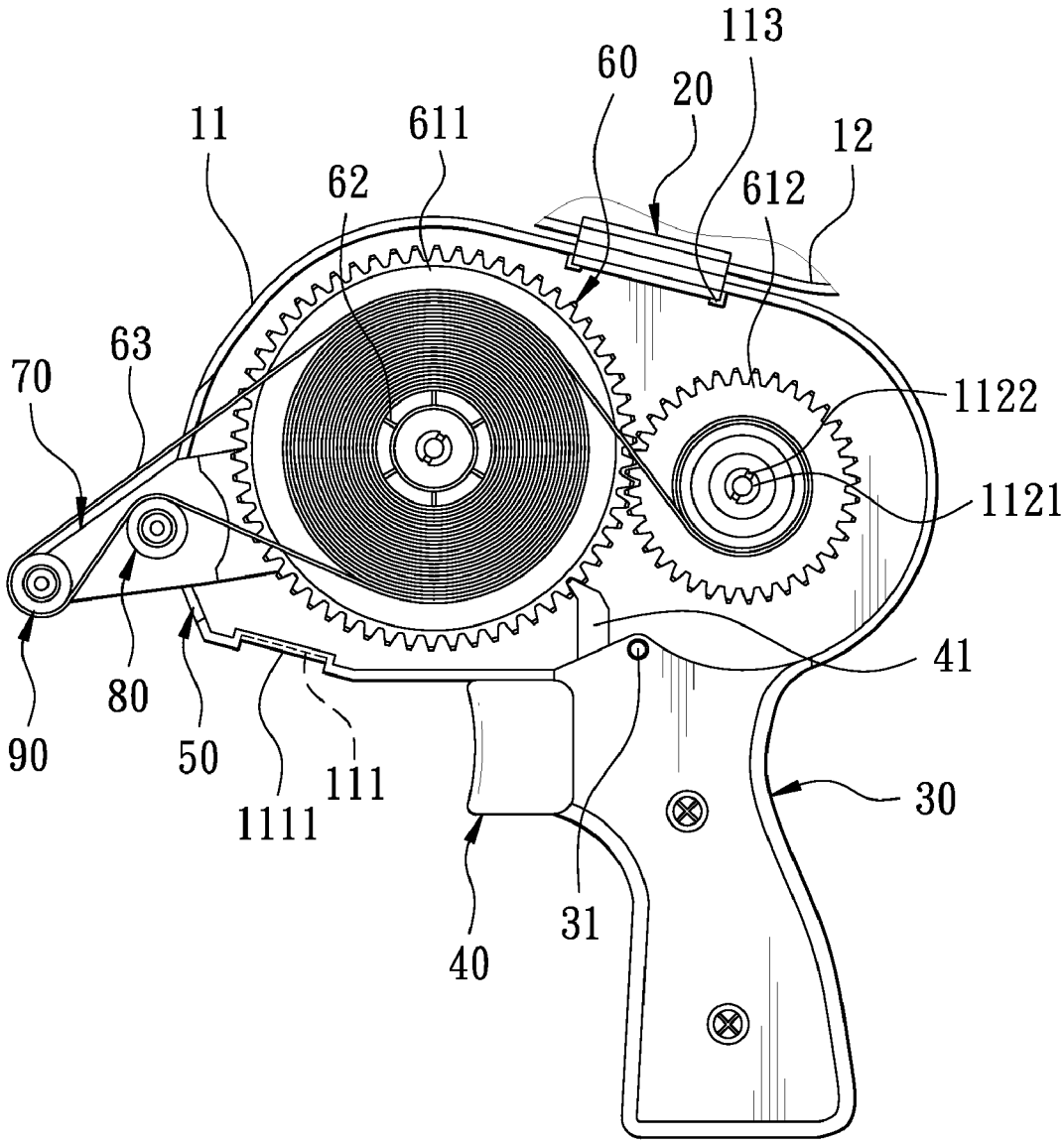
FIG. 4 is a side cross-sectional view of the double-sided adhesive tape dispenser in the present invention.

A preferred embodiment of a double-sides adhesive tape dispenser in the present invention, as shown in FIGS. 2, 3 and 4, includes a main housing 10, a pivotal member 20, a handle unit 30, and a tape-winding mechanism 60 as main components combined together.

The main housing 10 is composed of a fitting casing 11 and a fitting cover 12 respectively provided with an insert recess 111 and an engage member 121 to be engaged with each other. In this preferred embodiment, the insert recess 111 is disposed at the outer circumferential wall of the fitting casing 11, dented inward and provided with a first projecting edge 1111 extending outward at an engaging location corresponding with the engage member 121 of the fitting cover 12. The engage member 121 is fixed at the circumferential wall of the fitting cover 12 and has its opposite sides respectively bored with a long through hole 1211. The engage member 121 of the fitting cover 12 is further formed with a second projecting edge 1212 extending inward at an engaging location matching with the insert recess 111 of the fitting casing 11. When the insert recess 111 of the fitting casing 11 is combined with the engage member 121 of the fitting cover 12, the first and the second projecting edge 1111 and 1212 will be firmly engaged with each other. The fitting casing 11 has two engage pins 112 positioned vertically side by side on its inner central portion. The two engage pins 112 have their upper outer circumferential walls respectively provided with an annular ring 1121 and the center of its upper end cut with a notch 1122. The fitting cover 12 is transparent, having its inside disposed with a cross-shaped engage projection 122 and plural projecting rings 123 to be respectively engaged with the engage pins 112 of the fitting casing 11. The notch 1122 cut in the upper center of the engage pin 112 enables the engage pin 112 to have micro-elasticity; therefore, when the annular ring 1121 on the upper outer circumferential wall of the engage pin 112 is engaged with the projecting ring 123 on the inner side of the fitting cover 12, they can be combined together comparatively tightly.

The pivotal member 20 is a plate 21, which is assembled on the corresponding upper side of both the fitting casing 11 and the fitting cover 12 to enable the fitting cover 12 to be movably and pivotally connected with the fitting casing 11. The pivotal member 20 has its central portion lengthwise formed with a recess 22, having a ligament-shaped member 23 provided at another side opposite to the bottom of the recess 22. In addition, the fitting casing 11 and the fitting cover 12 have one side of their inner circumferential walls respectively disposed with a first fitting member 113 and a second fitting member 124 to be respectively assembled with the pivotal member 20.

The handle unit 30 is formed at a lower side of the fitting casing 11, opposite to the pivotal member 20, and has its upper side bored with an insert hole 31 for the engage projection 122 of the fitting cover 12 to be engaged therein. Further, the handle unit 30 has the front side provided with a control member 40 having its upper side formed with an engage tooth 41, and the fitting casing 11 and the fitting cover 12 have their front ends mutually bored with a tape outlet 50, with the insert recess 111 of the fitting casing 11 and the engage member 121 of the fitting cover 12 positioned near one side of the tape outlet 50.

The tape-winding mechanism 60 installed in the fitting casing 11 is composed of a pair of winding wheels 61 respectively and pivotally fitted on the two engage pins 112 of the fitting casing 11. The two winding wheels 61 respectively have one end provided with a gear secured thereon, respectively fixed on the two engage pins 112 by means of the annular ring 1121. The two winding wheels 61 consist of a first winding wheel 611 and a second winding wheel 612, and the first winding wheel 611 has its outer end, opposite to the fitting casing 11, assembled with a tape reel 62 wound thereon with a roll of separable paper 63. A guide-press member 70 is provided at a location facing the outer side of the tape outlet 50 and pivotally disposed with a drive wheel 80 and a press roller 90, which are cylindrical shaped and made of rubber. The press roller 90 is pivotally assembled at the outer side of the guide-press member 70 for pressingly shifting the separable paper 63 and pressing adhesive tape to let the adhesive tape struck to an article, while the drive wheel 80 is pivotally positioned at the inner side of the guide-press member 70 for assisting to move the separable paper 63. Further, the actuating wheel 80 has its wheel surface annularly formed with several flanges 81 arranged side by side for diminishing the area of the actuating wheel 80 contacting with the adhesive tape to enable the double-sided adhesive tape dispenser to be easily dragged for use and let the adhesive not easily stuck to the actuating wheel 80. The actuating wheel 80 has its outer end, opposite to the fitting cover 12, engaged with the projecting ring 123 of the fitting cover 12. The separable paper 63 has its outer surface, which is stuck thereon with adhesive, passing along the actuating wheel 80 and then its inner surface passing along the press roller 90 and finally has its end secured on the second winding wheel 612. The engage tooth 41 of the control member 40 is engaged with the gear of the first winding wheel 611.

To replace the tape reel 62, only need to disengage the engage member 121 of the fitting cover 12 from the insert recess 111 of the fitting casing 11 to open the fitting cover 12. Since the fitting casing 11 and the fitting cover 12 are combined together by the pivotal member 20, after opened, the fitting cover 12 is movably and pivotally connected with the fitting casing 11 and hence needless to be taken off and placed at somewhere or held by hand for replacing the tape reel 62. After the tape reel 62 is replaced with a new one and the fitting cover 12 is covered on the fitting casing 11, the engage projection 122 and the engage member 121 of the fitting cover 12 will be respectively and firmly engaged with the insert hole 31 and the insert recess 111 of the fitting casing 12, preventing the fitting cover 12 from falling off.

Figure 5:
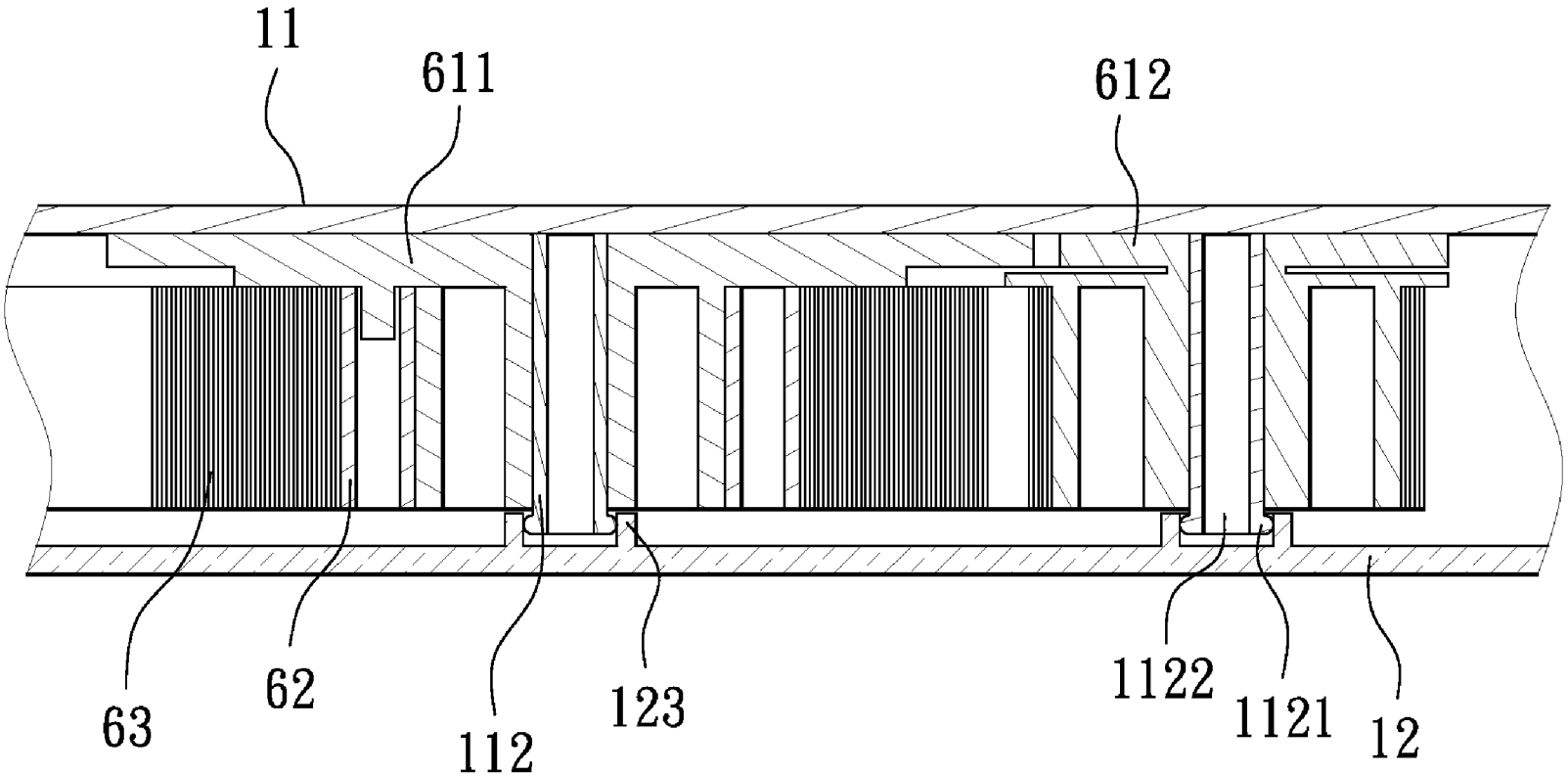
FIG. 5 is an upper cross-sectional view of the double-sided adhesive tape dispenser in the present invention.

In addition, referring to FIG. 5, after replacing the tape reel 62 and having the fitting cover 12 covered on the fitting casing 12, the engage pins 112 at the inner side of the fitting casing 12 will respectively be engaged with the projecting rings 123 of the fitting cover 12.

Figure 6:
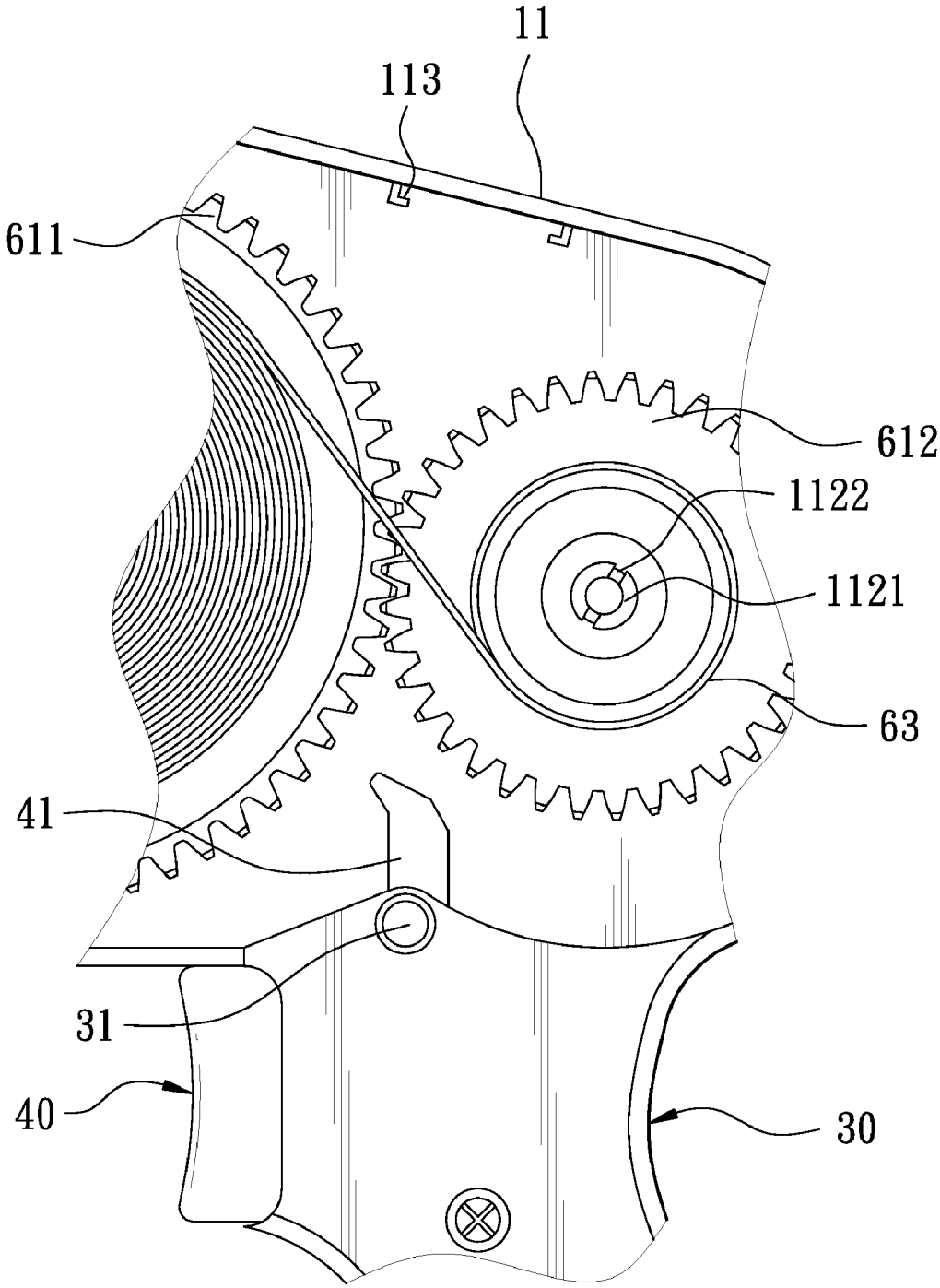
FIG. 6 is a side cross-sectional view of the double-sided adhesive tape dispenser in a partial operating condition in the present invention.

To use the double-sided adhesive tape dispenser, referring to FIG. 6, firstly, press the control member 40 to let the engage tooth 41 at one upper side of the control member 40 disengaged from the gear of the first winding wheel 611 to enable the double-sided adhesive tape dispenser to be dragged for use. After using, simply release the control member 40 to let the engage tooth 41 again engaged with the gear of the first winding wheel 611.

While the preferred embodiment of the invention has been described above, it will be recognized and understood that various modifications may be made therein and the appended claims are intended to cover all such modifications that may fall within the spirit and scope on the invention.

I claim:

1. A double-sided adhesive tape dispenser comprising:

a main housing composed of a fitting casing and a fitting cover, said fitting casing and said fitting cover having their corresponding sides mutually assembled with a pivotal member, said fitting casing formed with a handle unit at a lower side opposite to said pivotal member, said fitting casing and said fitting cover having their front ends mutually bored with a tape outlet, said fitting casing disposed with an insert recess and having two engage pins arranged vertically side by side on its inner wall side, said fitting cover provided with an engage member and an engage projection, said engage member and said insert recess positioned at one side near said tape outlet, said engage member engaged with said insert recess, said engage projection fixed at an inner side of said fitting cover, said handle unit having its upper side bored with an insert hole at a location matching with said engage projection, said engage projection engaged with said insert hole; and a tape-winding mechanism assembled in said fitting casing, said tape-winding mechanism composed of a pair of winding wheels, said winding wheels respectively having one end provided with a gear secured thereon, said winding wheels respectively fitted on said engage pins, said winding wheels consisting of a first winding wheel and a second winding wheel, said first winding wheel having another end mounted with a tape reel having a roll of separable paper wound thereon, said separable paper having its outer surface stuck with a double-sided adhesive tape, a guide-press member installed at a location facing said tape outlet of said fitting casing, said guide-press member pivotally disposed with a press roller and a drive wheel, said drive wheel having its wheel surface annularly formed with several flanges, said flanges arranged in parallel and side by side on a surface of said drive wheel, said separable paper having its outer surface passing along said drive wheel and then its inner surface passing along said press roller, said separable paper having its end fixed on said second winding wheel.

2. The double-sided adhesive tape dispenser as claimed in claim 1, wherein said pivotal member is a plate having a central portion of one side lengthwise formed with a recess and another side, opposite to the bottom of said recess, formed with a ligament-shaped member.

3. The double-sided adhesive tape dispenser as claimed in claim 1, wherein said fitting casing and said fitting cover have one side of their inner circumferential walls respectively disposed with a first fitting member and a second fitting member to be respectively combined with said pivotal member.

4. The double-sided adhesive tape dispenser as claimed in claim 1, wherein said insert recess is provided at a circumferential wall of said fitting casing, dented inward and provided with a first projecting edge extending outward at an engaging location corresponding with said engage member.

5. The double-sided adhesive tape dispenser as claimed in claim 1, wherein said engage member is provided at a circumferential wall of said fitting cover and has its opposite sides respectively bored with a long through hole, said engage member provided with a second projecting edge extending inward at an engaging location matching with said insert recess.

6. The double-sided adhesive tape dispenser as claimed in claim 1, wherein each said engage pin is a pillar fixed vertically inside said fitting casing, and has its upper outer circumferential wall disposed with an annular ring and its top central portion cut with a notch.

7. The double-sided adhesive tape dispenser as claimed in claim 1, wherein said fitting cover has its inner side fixed with plural projecting rings respectively corresponding with said engage pins and said drive wheel, said projecting rings respectively and firmly engaged with said engage pins and said drive wheel.

* * * * *